US006851416B1

(12) United States Patent
DeWitte et al.

(10) Patent No.: US 6,851,416 B1
(45) Date of Patent: Feb. 8, 2005

(54) ENGINE OPERATION ON AN UNKNOWN ETHANOL FUEL BLEND

(75) Inventors: Justin E. DeWitte, Ann Arbor, MI (US); John M. Prevost, Spring Arbor, MI (US); Zhong Li, Ypsilanti, MI (US); Howard W. Krausman, Dexter, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/644,351

(22) Filed: Aug. 20, 2003

(51) Int. Cl.[7] ..... F02B 13/00
(52) U.S. Cl. ..... 123/575
(58) Field of Search ..... 123/575, 576, 123/578, 688, 689, 486, 197.7; 73/118.1

(56) References Cited

U.S. PATENT DOCUMENTS 5,868,117 A 2/1999 Moote et al.
5,881,703 A 3/1999 Nankee, II et al.
5,941,217 A 8/1999 Cheng et al.
5,947,089 A 9/1999 Joyce et al.
5,950,599 A 9/1999 Rotramel et al.
5,957,094 A 9/1999 Krausman et al.
6,041,278 A 3/2000 Kennie et al.
6,289,881 B1 * 9/2001 Klopp ..... 123/525
6,324,835 B1 * 12/2001 Surnilla et al. ..... 60/274
6,715,462 B2 * 4/2004 Bidner et al. ..... 123/198 F
6,725,825 B1 * 4/2004 Kurtz et al. ..... 123/295

* cited by examiner

*Primary Examiner*—Mahmoud Gimie
(74) *Attorney, Agent, or Firm*—Ralph E. Smith

(57) ABSTRACT

A vehicle controller adjusts fuel delivered to an engine to compensate for an unknown fuel type being added to a fuel tank in a flexible fueled vehicle. The controller fuels a first set of engine cylinders according to first fueling scheme. For example, the controller fuels the first set assuming that E85 fuel was added to the fuel tank. The controller fuels a second set of engine cylinders according to a second fueling scheme. For example, the controller fuels the second set assuming that E0 fuel was added to the fuel tank. The controller continues to fuel the engine in this manner until an oxygen sensor becomes available. When the oxygen sensor becomes available, the vehicle controller may fuel the engine according to information from the oxygen sensor.

10 Claims, 2 Drawing Sheets

ENGINE OPERATION ON AN UNKNOWN ETHANOL FUEL BLEND

FIELD OF THE INVENTION

The present invention relates to fuel control systems, and more particularly to a method of controlling fuel delivery in a vehicle engine after adding an unknown fuel to a fuel tank of the vehicle.

BACKGROUND OF THE INVENTION

Environmental and energy concerns have stimulated the development of alternative fuels for use in automobiles. For example, alcohol fuels such as ethanol and methanol may be used. Flexible-fueled vehicles are capable of operating on gasoline, alcohol fuel, or any combination of the two fuels. Modifications to the engine are necessary when operating on different fuels because each fuel has different characteristics. An engine operating on ethanol or E85 fuel requires approximately 1.4 times the amount of fuel relative to gasoline due to a lower energy content of ethanol. E85 refers to a fuel blend of 85% ethanol and 15% gasoline. Similarly, E0 refers to a fuel with a 100% gasoline composition.

Air/fuel ratio in internal combustion engines is considered to be a ratio of mass air flow rate to mass fuel flow rate. The ratio corresponding to complete oxidization of the air/fuel mixture is referred to as stoichiometric. If the air/fuel ratio is less than stoichiometric, the engine is said to be operating rich. In other words, too much fuel is being delivered relative to the amount of air. Conversely, if the air/fuel ratio is more than stoichiometric, the engine is said to be operating lean. A lean condition indicates that not enough fuel is being delivered relative to the amount of air. An engine operating on an alcohol fuel requires a lower air/fuel ratio than an engine operating on gasoline. As the percentage of alcohol in the fuel increases, more fuel is required to lower the air/fuel ratio.

An oxygen sensor may be used to determine the percent alcohol content of the fuel in the engine. The oxygen sensor relays fuel composition information to the engine controller so variables such as air/fuel ratio can be adjusted accordingly. However, oxygen sensors take a predetermined amount of time to warm up, particularly in cold start conditions. Fuel composition learning systems cannot be used until the oxygen sensor is functioning correctly. Therefore, a potential for drivability deficiencies exists during a warm-up period if the vehicle has recently been filled with a fuel blend that differs from the previous fuel blend in the fuel tank.

SUMMARY OF THE INVENTION

A method of controlling fuel delivery in an engine after adding an unknown fuel to a fuel tank comprises controlling a fuel rate of a first set of engine cylinders according to a first fueling scheme. A fuel rate of a second set of engine cylinders is controlled according to a second fueling scheme. At least one set will be receiving fuel at an appropriate rate, allowing the engine to operate until an oxygen sensor is functioning.

In another aspect of the invention, a method of controlling fuel delivery in an engine comprises controlling a fuel rate of a first set of engine cylinders according to a first fueling scheme. A fuel rate of a second set of engine cylinders is controlled according to a second fueling scheme. An oxygen sensor determines if exhaust from the first and second set has an abnormal oxygen level. The fuel rate of at least one of the first and second sets is adjusted to correct the abnormal oxygen level.

In another aspect of the invention, a method of controlling fuel delivery in an engine comprises controlling a fuel rate of a first set of engine cylinders according to a first fueling scheme. A fuel rate of a second set of engine cylinders is controlled according to a second fueling scheme. A first oxygen sensor determines if exhaust from the first set has an abnormal oxygen level. A second oxygen sensor determines if exhaust from the second set has an abnormal oxygen level. The fuel rate of at least one of the first and second sets is adjusted to correct the abnormal oxygen level.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description is merely exemplary in nature and is in no way intended to limit the invention, its application, or uses.

Figure 1:
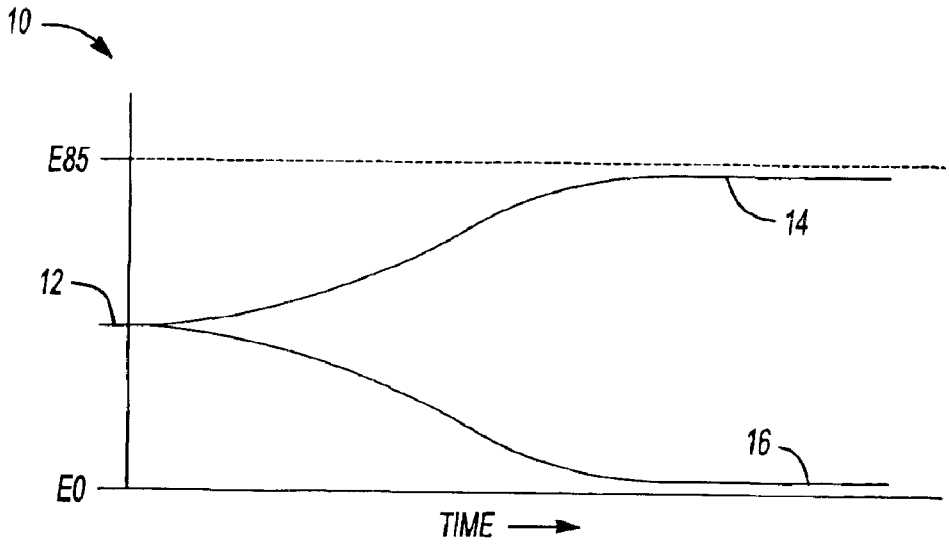
Fig-1 PRIOR ART
FIG. 1 illustrates a fuel possibility map according to the prior art.

A flexible fueled vehicle may operate with E85 fuel or E0 fuel, or any combination thereof. As shown in FIG. 1, a vehicle controller may adjust the air/fuel ratio in an engine to correspond to a fuel possibility map 10. The fuel possibility map 10 is used to adjust engine variables according to a possible new fuel composition. For example, a starting point 12 represents a last known fuel composition prior to the addition of new fuel. An E85 possibility curve 14 represents a possibility that E85 fuel was added to the fuel tank. An E0 possibility curve 16 represents a possibility that E0 fuel was added to the fuel tank. The controller calculates the E85 curve 14 and the E0 curve 16 based on the ethanol content of the old fuel mixture and two added fuel possibilities. In other words, the fuel possibility map 10 plots the fueling rate versus time for each fuel type.

The curves indicate the fuel content delivered to the engine. For example, if E85 fuel was added to the fuel tank, the vehicle controller adjusts air/fuel ratio according to the E85 curve 14. In one embodiment, the vehicle controller adjusts a fuel flow rate in order to control air/fuel ratio. The vehicle controller gradually increases the amount of E85 fuel delivered to the engine in order to lower the air/fuel ratio to a stoichiometric level. If the vehicle controller did not adjust air/fuel ratio and delivered fuel at a rate corresponding to the starting point 12, a lean condition would result. Conversely, if E0 fuel was added to the fuel tank, the vehicle controller adjusts air/fuel ratio according to the E0 curve 16. The vehicle controller gradually decreases the amount of E85 fuel delivered to the engine in order to raise the air/fuel ratio to a stoichiometric level and avoid a rich condition. Additionally, the vehicle controller may also adjust other engine conditions according to the fueling curves. For example, the vehicle controller may also adjust enrichments and spark timing to compensate for varying fuel rates. A more detailed explanation of possibility curves and fuel blending can be found in U.S. Pat. No. 6,257,174, entitled "Method of Determining the Composition of Fuel in a Flexible Fueled Vehicle After Fuel Blending," which is hereby incorporated by reference in its entirety.

However, in certain conditions, an oxygen sensor may not be available to determine what type of fuel was added to the fuel tank. An oxygen sensor provides closed loop operating capability, allowing the vehicle controller to make fuel control changes based on information from the oxygen sensor. During cold start conditions, a vehicle may run for a significant time after a fuel tank fill before closed loop operation is available. For example, the oxygen sensor may take a significant amount of time to warm up to a suitable operating temperature. Prior to closed loop operation, the engine may be susceptible to die-outs and drivability deficiencies due to improper fueling.

Figure 2:
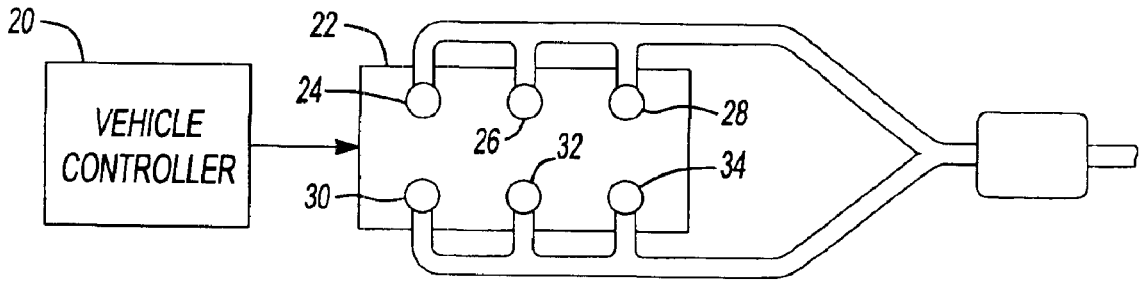
FIG. 2 is a functional block diagram of a fueling model according to the present invention.

According to the present invention, the vehicle controller 20 controls fuel delivery to the engine 22 as shown in FIG. 2. Upon starting the engine 22 after adding an unknown fuel to the fuel tank, the vehicle controller 20 controls fuel delivery to a first group of the engine cylinders 24, 26, 28 according to the E85 curve 14. The vehicle controller 20 controls fuel delivery to a second group of the engine cylinders 30, 32, 34 according to the E0 curve 16. The vehicle controller 20 determines fuel delivery based on a firing order of the cylinders. For example, the engine cylinders 24, 26, 28 may correspond to the first, third, and fifth cylinders in the firing order of the engine 22. Similarly, the engine cylinders 30, 32, 34 may correspond to the second, fourth, and sixth cylinders in the firing order.

Therefore, half of the cylinders in the engine 22 will be fueled properly and will operate at full torque. The other half will be fueled incorrectly and will have operating deficiencies, depending on the last known fuel composition as indicated by the starting point 12. For example, if the last known fuel composition was approximately E65 (65% ethanol, 35% gasoline), the cylinders 24, 26, 28 will be receiving enough fuel to operate at full torque. The cylinders 30, 32, 34, which will be fueled according to the E0 curve 16, will not receive enough fuel. However, the properly-fueled cylinders will provide full torque, thereby operating the vehicle until the oxygen sensor is available.

Figure 3:
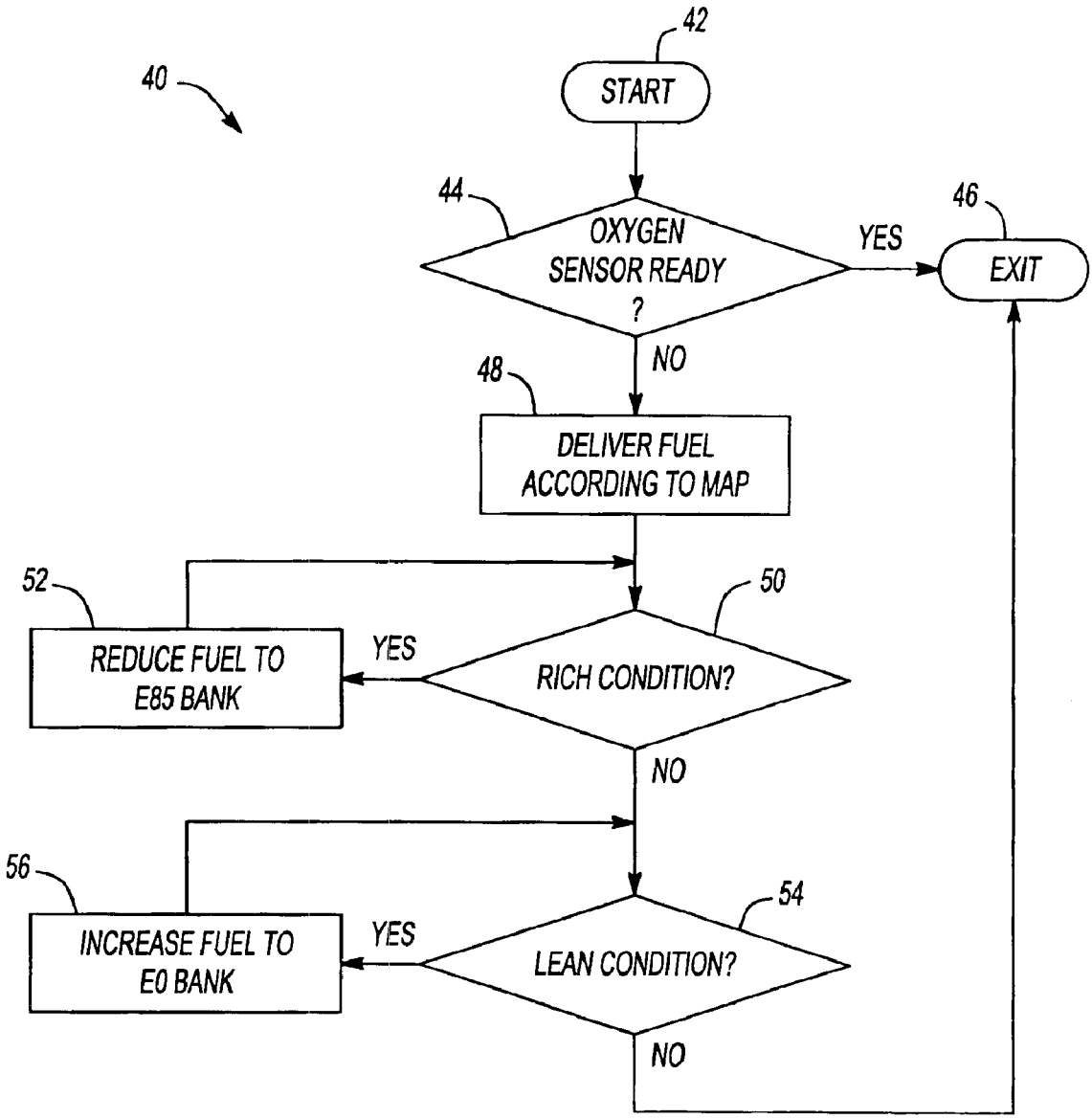
FIG. 3 is a flowchart of a method of flexible fuel control according to the present invention.

An algorithm 40 for flexible fuel control prior to oxygen sensor availability is shown in FIG. 3. Step 42 indicates the beginning of the algorithm, which is typically at engine startup. At step 44, the algorithm 40 determines whether the vehicle's oxygen sensor is available for closed loop operation. If the oxygen sensor is available, the algorithm 40 terminates at step 46. Because the oxygen sensor is available, fuel delivery can be controlled based on the percent alcohol content that the oxygen sensor determines. If the oxygen sensor is not available, the algorithm 40 advances to step 48.

At step 48, the algorithm 40 begins to deliver fuel according to the fuel possibility map 10 (as shown in FIG. 1). The algorithm 40 delivers fuel to a first set of the engine cylinders according to the E85 curve 14 and to a second set of the engine cylinders according to the E0 curve 16. The E85 curve 14 assumes that E85 fuel was added to the fuel tank, resulting in a greater overall ethanol percentage. The E0 curve assumes that E0 fuel was added to the fuel tank, resulting in a lesser overall fuel ethanol percentage. The algorithm 40 continues to fuel the engine cylinders according to the fuel possibility map 10 until the oxygen sensor becomes available.

Once the oxygen sensor becomes available, the algorithm 40 determines if the engine is operating rich or lean. The algorithm 40 determines if the engine is operating rich at step 50. If the engine is operating rich, the algorithm 40 adjusts fuel delivery at step 52. If the oxygen sensor senses a rich condition, the first or second engine set is not burning all of the fuel delivered. Assuming that either the first set or the second set is being fueled correctly, the other set is receiving too much or too little fuel. Because the first set is receiving fuel based on the E85 curve 14, the first set is receiving fuel at a higher rate. If any fuel with less than 85% ethanol was added, a rich condition would result. Therefore, the algorithm 40 reduces fuel delivery to the first set by a small amount. For example, the algorithm 40 may reduce fuel delivery to the first set by 3–5%.

Likewise, if the oxygen sensor senses a lean condition at step 54, either the first set or the second set is not receiving enough fuel. Because the second set is receiving fuel based on the E0 curve 14, the second set is receiving fuel at a lower rate. Therefore, if any fuel with more than 0% ethanol was added, a lean condition would result. Therefore, the algorithm 40 increases fuel delivery to the second set by a small amount at step 56. The algorithm 40 continues to either reduce fuel to the first set or increase fuel to the second set until the rich or lean condition is corrected. At this time, both the first set and the second set will be receiving fuel at approximately the same rate. For example, the algorithm 40 may adjust fuel delivery until the fueling rate of the first set is within a threshold of the fueling rate of the second set. In the preferred embodiment, the threshold is 10%, although other suitable thresholds may be used. Alternatively, the algorithm 40 may average the fuel rates of the first and the second set once the threshold is met.

In another embodiment, the flexible fuel system may use a first oxygen sensor for the first set and a second oxygen sensor for the second set. In this manner, the first oxygen sensor senses the exhaust from the first set to determine a rich or lean condition. The second oxygen sensor senses the exhaust from the second set to determine a rich or lean condition. The algorithm 40 may then adjust the fueling rates of the first set and/or the second set accordingly.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of controlling fuel delivery in an engine after adding an unknown fuel to a fuel tank, comprising:

controlling a fuel rate of a first set of engine cylinders according to a first fueling scheme that assumes a first fuel type was added to the tank; and controlling a fuel rate of a second set of engine cylinders according to a second fueling scheme that assumes a second fuel type was added to the tank.

2. The method of claim 1 wherein the first fuel type is E85 fuel and the second fuel type is E0 fuel.

3. A method of controlling fuel delivery in an engine after adding an comprising:

controlling a fuel rate of a first set of engine cylinders according to a a fueling map calculated at a controller; and controlling a fuel rate of a second set of engine cylinders according to a second fueling scheme based on said fueling map calculated at said controller, controlling a fueling map is calculated according to at least one of a age, a previous fuel volume, and a new fuel volume.

4. A method of controlling fuel delivery in an engine after adding an own fuel to a fuel comprising:

controlling a fuel rate of a first set of engine cylinders according to a first fueling scheme which assumes the unknown fuel is of a first fuel type;

controlling a fuel rate, of a second set of engine cylinders according to a second fueling scheme which assumes the unknown fuel is of a second type;

determining if exhaust from the first set and exhaust from the second set has an oxygen level of at least one of a lean condition and a rich condition adjusting the fuel rate of at least one of the first and second sets to correct the oxygen level.

5. The method of claim 4 wherein the first fuel type is E85 fuel and the second fuel type is E0 fuel.

6. The method of claim 5 wherein adjusting the fuel rate includes decreasing the fuel rate of the first set if the oxygen level indicates a rich condition.

7. The method of claim 6 wherein adjusting the fuel rate includes increasing the fuel rate of the second set if the oxygen level indicates a lean condition.

8. The method of claim 7 wherein adjusting the fuel rate includes adjusting the fuel rate until the fuel rate of the first set is within a threshold of the fuel rate of the second set.

9. A method of controlling fuel delivery in an engine after adding an unknown fuel to a fuel tank comprising:

controlling a fuel rate of a first set of engine cylinders according to a first fueling scheme that assumes a first fuel type was added to the tank;

controlling a fuel rate of a second set of engine cylinders according to a second fueling scheme mat assumes a second fuel type was added to the tank;

determining exhaust from the first set has an abnormal oxygen level at a first oxygen sensor;

determining if exhaust from the second set has an abnormal oxygen level at a second oxygen sensor;

adjusting the fuel rate of at least one of the first and second sets to correct the abnormal oxygen level.

10. The method of claim 9 wherein the first fuel type is E85 fuel and the second fuel type is E0 fuel.

* * * * *